US005240827A

United States Patent [19]

Lewis

[11] Patent Number: 5,240,827

[45] Date of Patent: Aug. 31, 1993

[54] PHOTOGRAPHIC ELEMENT CONTAINING LARGE, SELENIUM-SENSITIZED SILVER CHLORIDE GRAINS

[75] Inventor: John D. Lewis, Webster, N.Y.

[73] Assignee: Eastman Kodak Company, Rochester, N.Y.

[21] Appl. No.: 652,511

[22] Filed: Feb. 8, 1991

[51] Int. Cl.[5] ..... G03C 1/005

[52] U.S. Cl. ..... 430/603; 430/605; 430/567; 430/569

[58] Field of Search ..... 430/567, 605, 569, 603

[56] References Cited

U.S. PATENT DOCUMENTS 1,602,592 10/1926 Shepard .
3,442,653 5/1969 Dunn .
3,531,289 9/1970 Wood .
3,736,141 5/1973 Overmann et al. .
4,035,185 7/1977 Evans et al. .
4,063,951 12/1977 Bogg ..... 430/567
4,395,478 7/1983 Hoyen .
4,407,197 10/1983 McVeigh .
4,407,197 10/1983 McVeigh .
4,435,501 3/1984 Maskasky .
4,439,520 3/1984 Kofron et al. .
4,471,050 9/1984 Maskasky .
4,863,844 9/1989 Okumura et al. .

FOREIGN PATENT DOCUMENTS 50-071322 6/1975 Japan .
50-071323 6/1975 Japan .
50-071324 6/1975 Japan .

*Primary Examiner*—Charles L. Bowers, Jr.
*Assistant Examiner*—Thorl Chen
*Attorney, Agent, or Firm*—Foley & Lardner

[57] ABSTRACT

This invention describes the use of a selenium sensitizer on a large grain size silver chloride emulsion. The process of the invention provides a large and unexpected speed increase on silver chloride emulsion crystals greater than about 0.4 micron in edge length. A photosensitive emulsion according to the invention is particularly useful as a yellow layer in a color print film.

18 Claims, No Drawings

PHOTOGRAPHIC ELEMENT CONTAINING LARGE, SELENIUM-SENSITIZED SILVER CHLORIDE GRAINS

TECHNICAL FIELD

This invention relates to silver halide photographic elements, particularly to large-grain size silver halide photographic elements which have been chemically sensitized with sulfur and gold.

BACKGROUND OF THE INVENTION

Selenium sensitization of silver halide emulsions has been proposed for a variety of photosensitive systems. See, for example, Wood U.S. Pat. No. 3,531,289, issued Sep. 29, 1970, Hoyen U.S. Pat. No. 4,395,478, issued Jul. 26, 1983, Maskasky U.S. Pat. No. 4,435,501, issued Mar. 6, 1984, and Kofron et al. U.S. Pat. No. 4,439,520, issued Mar, 27, 1984. Selenium cyanide, in particular, has been used for chemical sensitization of silver halide materials. See Shepard U.S. Pat. No. 1,602,592, issued Oct. 12, 1926, McVeigh U.S. Pat. Nos. 4,408,196 and 4,407,197, issued Oct. 29, 1968, Dunn U.S. Pat. No. 3,442,653, issued May 6, 1969, Overmann et al. U.S. Pat. No. 3,736,141, issued May 29, 1973, and Japanese patent publication Nos. 50-071322, 50-071323 and 50-71324. In particular, the foregoing U.S. Pat. No. 3,442,653 describes sensitizing a silver halide emulsion with a noble metal and a labile selenium compound.

Chemical sensitization of silver chloride emulsions using sulfur and gold is well known. After the precipitation of photosensitive silver chloride grains in a gelatin medium is complete, it is a common practice to chemically sensitize the grains by addition of sulfur- and gold-containing compounds. These react with the surface of the AgCl crystals to improve the photographic performance of the film.

The effectiveness of sulfur and gold sensitization is limited under some circumstances. Normally, for a spectrally sensitized emulsion, the light sensitivity of an emulsion increases approximately in proportion to the surface area of the silver halide crystals. The present inventor discovered that the expected increase of sensitivity with increasing crystal size did not occur in an emulsion for the yellow layer of a color print film. In the case of the silver chloride emulsion in the yellow layer of a color print film, crystal size increases beyond about 0.35 micron edge length gave less speed than predicted. Beyond 0.45 micron edge length, the cubic crystals gave minimal further speed increases. This was a major problem because the film needs to have crystals of about 0.5 micron edge length with full sensitivity.

SUMMARY OF THE INVENTION

A photographic element according to the invention includes at least one photosensitive layer comprising an emulsion of silver halide grains of at least about 0.35 micron edge length. A selenium compound is incorporated on the surface of the grains in an amount effective to improve the speed of the photographic element. In particular, it been discovered that selenium sensitization, in addition to sulfur and gold, can overcome the failure to increase speed with crystal size in the above-described emulsion system. The effect of selenium sensitization on small silver chloride crystals optimally sensitized with sulfur and gold is negligible, but on large crystals there is a large speed increase using selenium, sulfur and gold in combination. This effect is unexpected.

DETAILED DESCRIPTION

It is not normally possible to obtain high light sensitivity with silver chloride emulsions in commercial photographic films as can be obtained by silver bromide and iodobromide emulsions. Hence, the advantageous characteristics of silver chloride emulsions, such as rapidity of development and lower processing chemical demand (with consequent lower environmental impact) cannot be realized for some film products. The present invention provides a method of increasing the maximum sensitivity of a silver chloride emulsion. Selenium sensitization, especially in combination with sulfur and gold sensitization, yields unexpectedly improved sensitivity in large silver chloride crystals.

Photographic elements according to the invention can be of various types, such as movie, X-ray, and reversal films, both color and black and white. According to a preferred embodiment of the invention, a yellow layer of a color film or print for use in color print development, i.e., for image transfer, is sensitized according to the invention. One such film comprises three successive silver halide emulsion layers coated onto a suitable support, such as paper or a cellulose triacetate film. The top layer is made sensitive to green light by treating the silver halide grains with a spectral sensitizing dye. The middle layer is similarly sensitive to red light, and the bottom layer to blue light. Upon exposure and development, the couplers present in each layer give magenta, cyan and yellow colors for the top, middle and bottom layers, respectively. Cubic silver chloride grains have been employed in the yellow layer of such elements. If such grains are treated in accordance with the invention, the sensitivity of the resulting color print film is enhanced. This is particularly important in the foregoing system wherein the yellow layer is on the bottom. The bottom layer needs to have optimum sensitivity because incident light must pass through the two overlying layers, and normally a top protective layer as well, in order to reach the bottom layer.

A photographic element according to the invention such as the foregoing color print film is prepared by first forming silver chloride grains in a colloidal matrix by precipitation methods known in the art. The AgCl grains preferably have cubic structure, although other grain geometries such as cubooctahedral or tabular could be used. The colloid is typically a hydrophilic film forming agent such as gelatin or alginic acid. Other conventional coating addenda, such as surfactants, hardeners, and plasticizers, may also be used in the preparation of the emulsion.

The precipitation conditions are controlled so that large AgCl grains are obtained. In particular, higher temperatures and longer precipitation times tend to produce larger crystals. Such large grains generally have an edge length of at least 0.35 micron, preferably at least about 0.5 micron, with a range of 0.5 to 1.0 μm being most useful in practice.

The AgCl grains, after being precipitated and washed in a conventional manner, are surface-treated with chemical and then spectral sensitizers. The emulsion is first heated to a temperature of about 40° C. to render the emulsion flowable. Preferably, a gold sensitizer, a sulfur sensitizer, and the selenium sensitizer of the invention are added to the emulsion. The sensitizers may be added to the heated emulsion simultaneously or several minutes apart to form a reaction product on or near the surface of the crystals.

Preferred sulfur sensitizers include compounds such as allyl isothiocyanate, sodium thiosulfate and allyl thiourea. The gold-containing sensitizer is preferably an aurate salt such as potassium or sodium tetrachloroaurate. The gold sensitizer is particularly effective for improving sensitivity at short exposure times, whereas sulfur provides the main sensitizing effect. The amounts of the sulfur and gold sensitizers may be those generally used in the art. A sodium thiosulfate sensitizer is used at a concentration in a preferred range of 0.1 to 45 mg per silver mole in emulsions with crystals of sizes ranging from about 0.1 to 1.5 microns diameter. A potassium tetrachloroaurate sensitizer is preferably used at a concentration in the range of 0.03 to 20 mg per silver mole in emulsions with crystals in the foregoing size range. Other comparable sensitizers known in the art may also be employed in combination with the selenium sensitizer, e.g., other noble metals such as platinum. The spectral sensitizer is normally added last, although it can be effectively added before the sulfur and gold. For this purpose any sensitizing dye of the required color, such as a cyanine, merocyanine, or carbocyanine, is added.

The selenium sensitizer is preferably a selenium salt such as KSeCN, NaSeCN or dimethyl selenourea. Any selenium compound which does not interfere with the properties of the emulsion and which can react to form silver selenide on the surfaces of the crystals may be used. The concentration of the selenium compound may vary, although an Se salt concentration between 0.01 to 2 mg/mole AgCl, especially 0.05 to 0.2 mg/mole AgCl, is most preferred. Less than 0.01 mg of the selenium sensitizer provides insufficient effects, whereas excessive selenium (e.g., more than 2 mg per mole AgCl) causes fogging.

Following addition of the sensitizers, the emulsion is preferably ripened at an elevated temperature. This involves heating the treated grains to a temperature of at least 50° C., generally in the range of 50° to 70° C. for at least about 10 minutes. The time for the selenium sensitization reaction is important. A fog problem arises if the reaction time is too long, whereas insufficient speed is obtained if the reaction time is too short. Accordingly, the sensitization reaction time is normally in the range of 10 to 180 minutes, preferably 20–90 minutes. It will be recognized that time, temperature and reactant concentration are somewhat interdependent in this type of reaction. For example, increasing the thiosulfate concentration can allow the same effects to be obtained in a shorter time. For this reason actual effective time and temperature ranges may vary depending on the specific emulsion employed.

After sensitization, the emulsion, in the form of a melt, is combined with a further gelatin melt containing the coupler. This is commonly done using a pair of metering pumps which feed the melts into a common flow line for application to the film. The film is wound over the surface of a roller and transported past a nozzle which coats the film with the combined melts. The coated film is then chilled to solidify the emulsion, for example, to 1° C. or lower. The film may then be forced-air dried and cut into strips suitable for use in photographic applications such as those described above.

As shown by Examples 2–4 and 6–9 below, the use of selenium-containing salts as sensitizers improve the effect of sulfur and gold sensitization of large silver chloride emulsions. This effect is not seen on small silver chloride emulsion crystals (Examples 1 and 4), or when the selenium salt is used as a dopant, i.e., incorporated into the grains during precipitation.

The following examples illustrate the practice of this invention. Amounts given in Examples 5–9 are in mg per mole of silver unless specified otherwise.

EXAMPLE 1

Precipitation of a silver chloride emulsion containing small silver chloride crystals was carried out by combining the following in a kettle at a temperature of 40° C.:

| | |
|---|---|
| Rousselot Gelatin Type 4, deionized | 400 gm |
| Nalco antifoam (surfactant) | 0.5 ml |
| Deionized Water | 3692 gm |

The pAg was adjusted to a control set point of 7.58. A silver solution containing the following was then prepared:

| | |
|---|---|
| Silver nitrate | 4.5 M |
| Mercuric chloride | 0.071 mg/Ag mole |
| Nitric acid | 0.024 M |

The foregoing silver solution together with a 5.0M sodium chloride salt were added to the gelatin solution in the kettle over a period of 39.9 mins controlling temperature and pAg to the given set points. The initial silver flow rate was 22 ml/min ramped (increased at a constant rate) to 115 ml/min at the end of 39.9 minutes. The emulsion was cooled to 43.3° C. and ultrafiltered to give an electrode voltage of 190 mV. 741.1 gm of Rousselot gelatin was added with 3.4 gm of 4-chloro-3,5-xylenol, and the emulsion was chill set for storage at 4° C. The final crystals had a 0.205 micron edge length.

EXAMPLE 2

A silver chloride emulsion containing medium-sized cubic silver chloride crystals was prepared as described in Example 1, except as follows. Precipitation of a silver chloride emulsion containing silver chloride crystals was carried out using a kettle temperature of 65° C. and a pAg control set point of 6.99. The silver solution together with a 4.5M sodium chloride salt were added to the gelatin solution in the kettle. Ultrafiltration gave an electrode voltage of 190 mV, after which the amount of Rousselot gelatin added was 906.0 gm. The final crystals had a 0.442 micron edge length.

EXAMPLE 3

A silver chloride containing large cubic silver chloride crystals was prepared as described in Example 1, except as follows. Precipitation of the silver chloride emulsion containing silver chloride crystals was carried out using a kettle temperature of 70° C. and a pAg control set point of 6.88. The silver solution together with a 4.5M sodium chloride salt were added to the gelatin solution in the kettle. Ultrafiltration gave an electrode voltage of 190 mV, after which the amount of Rousselot gelatin added was 1003.7 gm. The final crystals had a 0.503 micron edge length.

EXAMPLE 4

A silver chloride emulsion containing large cubic silver chloride crystals was prepared as described in Example 3, except as follows. The silver solution contained the following:

| | |
|---|---|
| Silver nitrate | 4.5 M |
| Mercuric chloride | 0.067 mg/Ag mole |
| Nitric acid | 0.022 M |

Ultrafiltration gave an electrode voltage of 160 mV, after which the amount of Rousselot gelatin added was 954.0 gm. The final crystals had a 0.534 micron edge length.

EXAMPLE 5

Selenium, sulfur and gold sensitization of the emulsion of Example 1 containing small silver chloride crystals was carried out using potassium selenocyanate. A finishing formula having the following composition was prepared:

| | |
|---|---|
| Potassium bromide | 559 mg/Ag mole |
| Potassium selenocyanate | See TABLE 1 |
| Sodium thiosulfate | 3.20 mg/Ag mole |
| Potassium tetrachloroaurate | 1.5 mg/Ag mole |

The chill-set emulsion of Example 1 was heated in the dark to 40° C. to melt the gelatin. The silver concentration of the emulsion was then measured by titration, and an amount of emulsion containing one silver mole was determined. The finishing formula was then added to the resulting melt in amounts effective to produce the concentrations listed above. This mixture was heated gradually from 40° to 70° C. over about 16 minutes. The mixture was then held at 70° C. for 60 minutes to allow the reaction on the surfaces of the cubic AgCl grains to proceed, and then chilled to 43.3° C. The following dye composition was then added:

| | |
|---|---|
| Blue sensitizing dye | 498 mg/Ag mole |
| 1-3, acetamidophenyl-5-mercaptotetrazole | 97.5 mg/Ag mole |
| Potassium bromide | 1600 mg/Ag mole |

The resulting sensitized emulsion was then chill set and stored at 4° C. The blue dye had the formula:

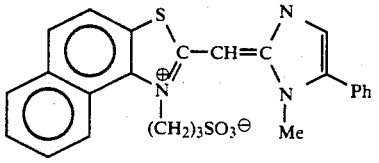

The sensitized emulsion was later remelted and coated on a cellulose triacetate film base in combination with a coupler-containing dispersion (melt) using conventional coating procedures under the following conditions:

Emulsion Melt

| | |
|---|---|
| Emulsion, Silver | 70.5 mg/sq. ft. |

-continued

| | |
|---|---|
| Emulsion, Gel | 138.6 mg/sq. ft. |

Coupler Melt

| | |
|---|---|
| Yellow coupler | 175 mg/sq. ft. |
| Gelatin | 149 mg/sq. ft. |
| 3,5-disulfocatechol, disodium salt | 23.8 mg/sq. ft. |
| Triton 200 surfactant | 4.3 mg/sq. ft. |
| Olin 10G surfactant | 2.2 mg/sq. ft. |
| Surface overcoat, gel | 90.8 mg/sq. ft. |
| Bisvinyl sulfonyl methane | 1.60% of total gelatin |

The yellow coupler had the formula:

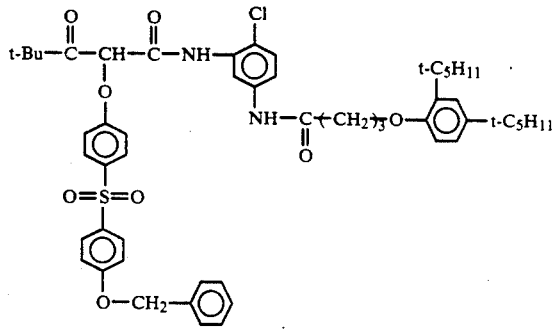

For purposes of the invention, each of the foregoing melt amounts can generally be varied between about 25 to 200 percent of the values given above.

The coated film was subjected to densitometry to measure yellow color density. The coated film was exposed for 0.002 seconds using a Macbeth densitometer at a bulb temperature of 2850° K. The exposed film was then developed using the ECP-2 process at 98° C. according to the procedure described in Eastman Color Films Publication #H24 using a 3 minute development time. Fog level and speed were then determined, and the results are set forth in Table 1.

TABLE 1

| KSeCN mg/Ag mole | Dmin | Speed at 1.0 + fog |
|---|---|---|
| 0.00 | 0.10 | 91 |
| 0.01 | 0.10 | 95 |
| 0.04 | 0.10 | 95 |
| 0.09 | 2.04 | 95 |

The results indicate insignificant improvement in speed for small crystal sizes at selenium levels ranging from 0.01–0.09 mg/Ag mole. When the concentration was increased to 0.09, the fog level ($D_{min}$) became excessive with no further speed increase.

EXAMPLE 6

The procedure of Example 5 was repeated, except as follows. The emulsion of Example 2 was used in place of the emulsion of Example 1. The finishing formula contained:

| | |
|---|---|
| Potassium bromide | 227 mg/Ag mole |
| Potassium selenocyanate | See TABLE 2 |
| Sodium thiosulfate | 0.50 |

-continued

| | |
|---|---|
| Potassium tetrachloroaurate | 0.75 |

The dye composition contained:

| | |
|---|---|
| Dye | 321 mg/Ag mole |
| 1-3, Acetamidophenyl-5-mercaptotetrazole | 97.5 |
| Potassium bromide | 1600 |

The results are given in Table 2:

TABLE 2

| KSeCN mg/Ag mole | Dmin | Speed at 1.0 + fog |
|---|---|---|
| 0.00 | 0.07 | 123 |
| 0.08 | 0.10 | 163 |

The results show a significant improvement in speed for a medium crystal size at 0.08 mg selenium, without a large increase in fog.

EXAMPLE 7

The procedure of Example 5 was repeated, except as follows. The emulsion of Example 3 was used in place of the emulsion of Example 1. The finishing formula contained:

| | |
|---|---|
| Potassium bromide | 200 mg/Ag mole |
| Potassium selenocyanate | See TABLE 3 |
| Sodium thiosulfate | 0.45 |
| Potassium tetrachloroaurate | 0.66 |

The dye composition contained:

| | |
|---|---|
| Dye | 283 mg/Ag mole |
| 1-3, Acetamidophenyl-5-Mercaptotetrazole | 97.5 |
| Potassium bromide | 1600 |

The results are given in Table 3:

TABLE 3

| KSeCN mg/Ag mole | Dmin | Speed at 1.0 + fog |
|---|---|---|
| 0.00 | 0.11 | 142 |
| 0.08 | 0.10 | 169 |
| 0.10 | 0.10 | 170 |
| 0.12 | 0.22 | 179 |

The results show a significant improvement in speed for large crystals at selenium levels ranging from 0.08–0.1 mg/Ag mole. When the concentration was increased to 0.12, the fog level ($D_{min}$) became greater, but was still less than 0.25, the preferred maximum amount of fog which can be tolerated.

EXAMPLE 8

The procedure of Example 5 was repeated, except as follows. The emulsion of Example 4 was used in place of the emulsion of Example 1. The finishing formula contained:

| | |
|---|---|
| Potassium bromide | 190 |
| Dimethyl selenourea | See TABLE 4 |
| Sodium thiosulfate | 0.43 |

-continued

| | |
|---|---|
| Potassium tetrachloroaurate | 0.40 |

The dye composition contained:

| | |
|---|---|
| Dye | 269 |
| 1-3, Acetamidophenyl-5-mercaptotetrazole | 97.5 |
| Potassium bromide | 1600 |

The results are given in Table 4:

TABLE 4

| KSeCN mg/Ag mole | Dmin | Speed at 1.0 + fog |
|---|---|---|
| 0.00 | 0.06 | 159 |
| 0.02 | 0.07 | 165 |
| 0.04 | 0.08 | 176 |
| 0.08 | 0.09 | 184 |

The results again show a significant improvement in speed for large crystals at selenium levels ranging from 0.02–0.08 mg/Ag mol, with low fog.

EXAMPLE 9

The procedure of Example 6 was repeated, except as follows. To provide a better basis for comparison, the amount of sodium thiosulfate was decreased in the sample wherein the selenium sensitizer was added. The finishing formula contained:

| | |
|---|---|
| Potassium bromide | 227 |
| Potassium selenocyanate | See TABLE 5 |
| Sodium thiosulfate, no Se | 0.87 |
| Sodium thiosulfate, with Se | 0.50 |
| Potassium tetrachloroaurate | 0.75 |

The dye composition contained:

| | |
|---|---|
| Dye | 321 mg/Ag mole |
| 1-3, Acetamidophenyl-5-mercaptotetrazole | 97.5 |
| Potassium bromide | 1600 |

The results are given in Table 5:

TABLE 5

| KSeCN mg/Ag mole | Dmin | Speed at 1.0 + fog |
|---|---|---|
| 0.00 | 0.08 | 136 |
| 0.08 | 0.10 | 163 |

A good improvement in speed was again obtained without a significant increase in fog.

While several embodiments of the invention have been described, it will be understood that it is capable of further modifications, and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

I claim:

1. A photographic element comprising a layer of a silver chloride photosensitive emulsion disposed on a support, the photographic element being improved in that the silver chloride grains consist essentially of cubic AgCl grains having an average edge length of at least about 0.4 micron, which cubic grains have been sensitized with sulfur and gold in amounts effective as sensitizers on the surface of said grains, and with a selenium sensitizer incorporated on the surface of said grains in an amount of between 0.01 to 2 mg/mole AgCl effective to improve the speed of said photographic element.

2. The element of claim 1, wherein said selenium sensitizer is selected from KSeCN, NaSeCN and dimethyl selenourea.

3. The element of claim 1, comprising color print film wherein said layer comprises silver halide cubic grains in a yellow layer of at least about 0.5 micron edge length.

4. The element of claim 1, wherein Se is present in an amount of between 0.05 to 0.2 mg/mole AgCl.

5. The element of claim 1, wherein said edge length is between about 0.5 and 1.0 microns.

6. The element of claim 1, wherein the sulfur sensitizer consists essentially of sodium thiosulfate used in a concentration of 0.1 to 45 mg per silver mole, and the gold sensitizer consists essentially of potassium tetrachlorolaurate used in a concentration of 0.03 to 20 mg per silver mole.

7. The element of claim 1, wherein the grains have been spectrally sensitized with a dye.

8. The element of claim 7, wherein the dye is selected from a cyanine, merocyanine and carbocyanine dye.

9. A process for making a photographic element, comprising the steps of:

forming a photographic emulsion containing cubic grains consisting essentially of silver chloride and having an edge length of at least about 0.4 micron;

chemically sensitizing the photographic emulsion with gold and sulfur sensitizers;

chemically sensitizing the photographic emulsion with a selenium sensitizer, wherein said selenium sensitizer is present in an amount of between 0.01 to 2 mg/mole AgCl effective to improve the speed of said photographic element;

maintaining the emulsion at an elevated temperature for a time sufficient to allow the selenium sensitizer to react with the grain surfaces; and coating the sensitized emulsion on a support.

10. The process of claim 9, wherein said selenium sensitizer is KSeCN, NaSeCN or dimethyl selenourea.

11. The process of claim 9, wherein said selenium sensitizer is present in an amount of between 0.05 to 0.2 mg/mole AgCl.

12. The process of claim 9, further comprising spectrally sensitizing the emulsion with a dye.

13. The process of claim 12, further comprising adding a yellow coupler to the emulsion and spectrally sensitizing the emulsion to blue light.

14. The process of claim 13, further comprising overcoating the layer containing said emulsion with a second layer of a silver halide emulsion sensitive to red light and containing a cyan coupler, and overcoating said second layer with a third layer sensitive to green light and containing a magenta coupler to form a color film.

15. A photosensitive element made by the process of claim 9.

16. The process of claim 9, wherein the sulfur sensitizer consists essentially of sodium thiosulfate used in a concentration of 0.1 to 45 mg per silver mole, and the gold sensitizer consists essentially of potassium tetrachlorolaurate used in a concentration of 0.03 to 20 mg per silver mole.

17. The process of claim 9, wherein the emulsion is maintained at a temperature of at least about 50° C. for at least about 10 minutes.

18. The process of claim 16, wherein the emulsion is maintained at a temperature in the range of 50° C. to 70° C. for 10 to 180 minutes.

* * * * *